United States Patent [19]

Freeman

[11] 4,135,274

[45] Jan. 23, 1979

[54] LIQUID APPLICATOR

[76] Inventor: Catherine Freeman, 1662 Bayview Ave., Bronx, N.Y. 10465

[21] Appl. No.: 884,535

[22] Filed: Mar. 8, 1978

Related U.S. Application Data

[63] Continuation-in-part of Ser. No. 769,508, Feb. 17, 1977, abandoned.

[51] Int. Cl.[2] ..... A45D 34/04; B25G 1/04

[52] U.S. Cl. ..... 15/244 R; 15/144 B; 285/298; 403/109

[58] Field of Search ..... 15/143 B, 144 B, 244 A; 138/120; 248/333; 401/196; 403/109; 285/298

[56] References Cited

U.S. PATENT DOCUMENTS

| | | | |
|---|---|---|---|
| 1,951,023 | 3/1934 | Josselyn | 15/144 B X |
| 2,984,852 | 5/1961 | George | 15/144 B |
| 3,081,999 | 3/1963 | Harris | 285/298 X |
| 3,103,682 | 9/1963 | Markle | 15/144 B X |
| 3,188,675 | 6/1965 | Beck | 15/144 B X |
| 3,481,676 | 12/1969 | Schwartzman | 401/196 X |
| 3,731,682 | 5/1973 | Fielding | 128/269 X |
| 3,762,704 | 10/1973 | Gingras | 403/109 X |

*Primary Examiner*—Daniel Blum
*Attorney, Agent, or Firm*—Robert D. Farkas

[57] ABSTRACT

A liquid applicator that includes a liquid absorbent padded tip joined to a telescopically collapsible handle, such that the applicator may be easily stored. The handle elements are provided with stop members which prevent them from being disengaged from one another and detent which releasingly lockingly engages the telescopic elements in an extended position.

3 Claims, 3 Drawing Figures

LIQUID APPLICATOR

BACKGROUND OF THE INVENTION

This application is a continuation-in-part of prior U.S. application Ser. No. 769,508 filed Feb. 17, 1977, now abandoned.

This invention relates to a liquid applicator; more particularly to an applicator that includes an absorbent tip on a collapsible shaft. The applicator may be constructed in any desired length and dimension of absorbent pad, though an arcuate shaped, bulbous ended pad is preferred.

The prior art teaches a variety of sponge liquid applicators, for example, as disclosed in U.S. Pat. Nos. 1,857,145; 1,966,789; 2,218,738; 2,510,961; 2,741,787; 2,803,031; and others.

SUMMARY OF THE INVENTION

It is accordingly an object of the instant invention to provide for a new and improved liquid applicator of the type aforementioned.

It is another object to provide for one that is collapsible thereby reducing storage space and enabling one to carry it about on one's person if desired.

It is a further object to provide for the same at relatively little cost thereby making it generally available.

These and other objects and advantages of the invention will become more apparent from a consideration of the following detailed disclosure and claims and by reference to the accompanying drawings.

Broadly speaking, the instant invention includes the provision of a liquid applicator, comprising a plurality of hollow, walled open ended members, each member having a predetermined external and internal diameter, the members communicating with each other in series, each succeeding member having an internal diameter larger than the external diameter of the preceding member, the members being telescopically movable one into the other, first means disposed on the outer wall of one of the members adjacent the distal end thereof for arresting the movement thereof, second means disposed on the inner wall of the next succeeding member adjacent the proximate end thereof for arresting the movement thereof by cooperating with the first means, a liquid absorbent pad member disposed on the distal end of the first of the members, third means are disposed at or immediately adjacent to the distal end of the outer wall of the one member which when engaging the second means, at the time that the members are fully extended, prevents the members from becoming totally disengaged from one another.

DETAILED DISCLOSURE

Figure 1:
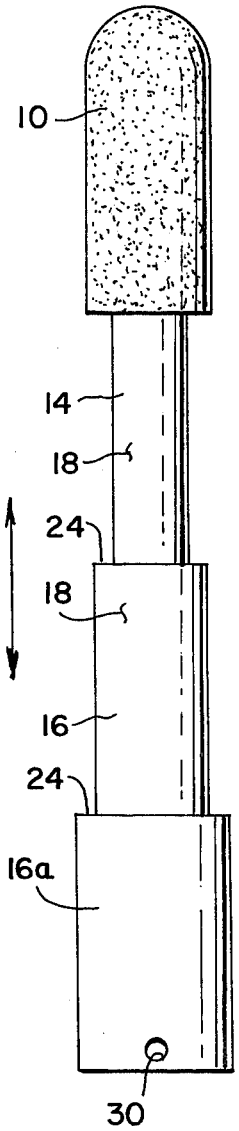
FIG. 1 is a top plan view.
Figure 2:
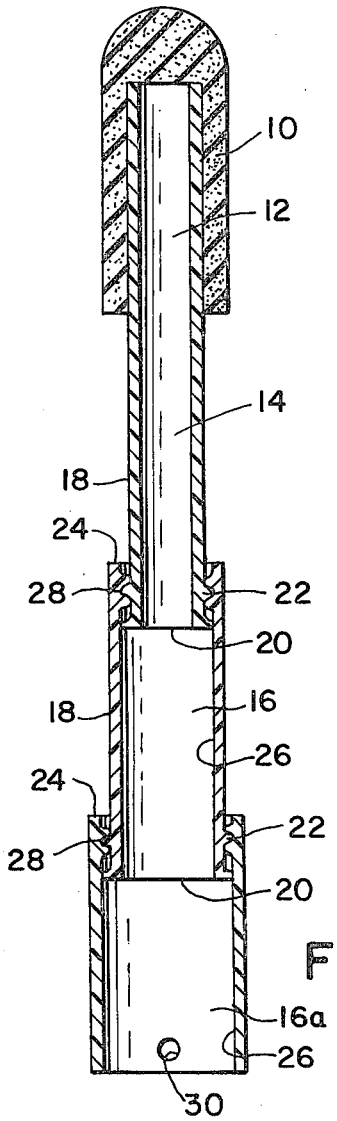
FIG. 2 is a longitudinal sectional view.
Figure 3:
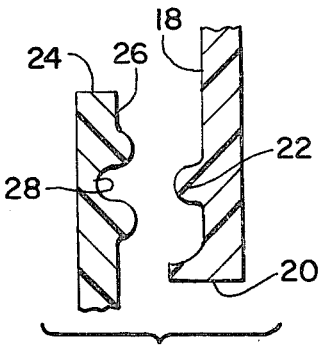
FIG. 3 is a detailed sectional view of a portion thereof.

Referring more particularly to the drawings, there is shown the instant liquid applicator which included an absorbent pad member 10, i.e., sponge, rubber, natural sponge, etc., disposed at one distal end thereof, such as where the member 10 is a sleeve open at one end to receive the end of the handle or portion of the handle therein. Alternatively, the member 10 may be merely secured (i.e., adhesively) to the distal end of the handle without actually receiving the same therein. In the first and preferred embodiment, however, the member 10 will have a predetermined internal diameter of the portion 12 of the handle 14 that is frictionally inserted therein in male-female relation. The handle 14 generally is constructed of a plurality of hollow-walled, yieldable plastic, telescopically movable sections 16, **16*a*, each section rearward of the first 14 that actually engages the member 10 being progressively larger in internal diameter to telescopically receive therein the next succeeding section 16*a*, which of necessity has a larger external diameter and so on. Such sections may, if desired, be fabricated from other materials. Each successive section will also in turn be at least as long as the preceding one to accommodate this engagement. The sections are generally circular in cross-section though they need not necessarily be so. The outer surface 18 of each section adjacent the rearward distal end 20 thereof will have means 22, i.e., an annular rib or at least a pair of nipples or protrusions thereon. Adjacent the proximate end 24 of the next succeeding section the internal wall 26 thereof will define means 28, e.e., an annular groove, a channel, as well or depression formed in the wall between a pair of opposing protrusions on the wall such that there is formed a locking mechanism, i.e., a male nipple and female grip as shown in FIG. 3 to prevent disengagement of the various sections. In this manner, as each section is telescopically brought out of the next succeeding section, the means 22, herein above described as the first means, on the distal end of the forward section engage the means 28, herein above described as the second means, on the proximate end of the next section such that the two sections 16, 16*a* will not disengage, etc. Flange-like members 32, located adjacent or at the distal most end 20 of sections 14 and 16, on outermost surfaces 18 thereof, herein above described as the third means, are adapted to engage the protrusion on the wall forming the inside of sections 16 and 16*a*, to be further insuring that section 14 will not disengage from section 16 nor will section 16 disengage from section 16*a*. Members 32 may be formed by flaring or in the same manner as means 22 are formed. If desired, an aperture 30 may be provided in the wall of the last section to facilitate hanging the device to dry the member 10**.

Since it is obvious that numerous changes and modifications can be made in the above-described details without departing from the spirit and nature of the invention, it is to be understood that all such changes and modifications are included within the scope of the invention.

I claim:

1. A liquid applicator, comprising a plurality of hollow walled open ended handle members, each member having a predetermined external and internal diameter, said members communicating with each other in series, each succeeding member having an internal diameter larger than the external diameter of the preceding member, said members being telescopically movable one into the other, first means disposed on the outer wall of one of said members adjacent the distal end thereof for arresting the movement thereof, second means disposed on the inner wall of said next succeeding member adjacent the proximate end thereof for arresting the movement thereof by cooperating with said first means, said first and second means forming a detent, flange means disposed on said outer wall of said one of said members at the distal-most end thereof for preventing the disengagement of said one of said members from said next succeeding member by cooperating with said second means, a unitary absorbent pad member disposed on the front end of the first of said members, said unitary liquid absorbent pad member being a sponge-like rubber-like material, wherein said pad member is a hollow sleeve open at one end for receiving said front end therein, and wherein said first means is a rib and said second means is a groove.

2. The applicator as defined in claim 1 where said first means is an annular rib and said second means is an annular groove.

3. The applicator as defined in claim 1 where said members have a circular cross-section.

* * * * *